US010189070B2

(12) United States Patent
Olesinska et al.

(10) Patent No.: US 10,189,070 B2
(45) Date of Patent: Jan. 29, 2019

(54) ROLLER FOR ROLL FORMING

(71) Applicant: Victaulic Company, Easton, PA (US)

(72) Inventors: Paulina A. Olesinska, Easton, PA (US); William C. Reilly, Langhorne, PA (US)

(73) Assignee: Victaulic Company, Easton, PA (US)

( * ) Notice: Subject to any disclaimer, the term of this patent is extended or adjusted under 35 U.S.C. 154(b) by 344 days.

(21) Appl. No.: 14/813,215

(22) Filed: Jul. 30, 2015

(65) Prior Publication Data

US 2016/0059293 A1 Mar. 3, 2016

Related U.S. Application Data

(60) Provisional application No. 62/043,591, filed on Aug. 29, 2014.

(51) Int. Cl.
*B21D 17/04* (2006.01)
*B21H 7/18* (2006.01)

(52) U.S. Cl.
CPC ..... *B21D 17/04* (2013.01); *B21H 7/182* (2013.01)

(58) Field of Classification Search
CPC ..... B21B 19/043; B21B 19/46; B21B 19/04; B21B 27/005; B21B 23/00; B21B 2023/005; B21D 17/04; B21H 7/182
USPC ..... 492/30
See application file for complete search history.

(56) References Cited

U.S. PATENT DOCUMENTS 338,867 A * 3/1886 Pattison ..... B21D 17/04 72/105
359,280 A * 3/1887 Pattison ..... B21D 17/04 72/105
2,809,687 A 10/1957 Ogle
3,688,538 A 9/1972 Hoyne
3,903,722 A 9/1975 Thau, Jr. et al.
3,995,466 A * 12/1976 Kunsman ..... B21D 17/04 72/105
4,114,414 A * 9/1978 Goodman ..... B21D 17/04 72/105

(Continued)

FOREIGN PATENT DOCUMENTS

JP 2008229726 A 10/2008

OTHER PUBLICATIONS

Thomas, Shane; International Search Report from corresponding International Patent Application No. PCT/US2015/044129; dated Nov. 12, 2015, pp. 1-2, United States Patent and Trademark Office as International Searching Authority, Alexandria, Virginia, USA.

(Continued)

*Primary Examiner* — Pradeep C Battula
(74) *Attorney, Agent, or Firm* — Ballard Spahr LLP

(57) ABSTRACT

A roller for engaging an outer surface of a pipe element during roll forming has a perimeter region defined by three faces. A channel is positioned in one of the faces. The channel extends circumferentially around the perimeter region and provides a void space that reduces the contact area between the face and the side surface of a circumferential groove formed in the pipe element during roll forming. The reduced contact area reduces frictional heating of the pipe and roller as well as the tendency of the roller to slip relative to the floor surface of the groove due to axial force engendered when an asymmetrical groove is formed.

22 Claims, 7 Drawing Sheets

(56) References Cited

U.S. PATENT DOCUMENTS

| | | | | |
|---|---|---|---|---|
| 5,246,256 | A * | 9/1993 | Rung | F16L 9/02 72/105 |
| 5,279,143 | A * | 1/1994 | Dole | B21D 17/04 72/105 |
| 5,570,603 | A | 11/1996 | Chatterley et al. | |
| 6,196,039 | B1 * | 3/2001 | Williams | B21D 17/04 72/105 |
| 6,968,720 | B2 | 11/2005 | Balagna et al. | |
| 7,379,703 | B2 * | 5/2008 | Ito | G03G 15/6552 492/28 |
| 8,550,502 | B2 | 10/2013 | Vandal et al. | |
| 8,777,277 | B2 * | 7/2014 | Dole | B21B 23/00 285/365 |
| 9,333,548 | B2 * | 5/2016 | Puzio | B21D 17/04 |
| 2012/0139236 | A1 * | 6/2012 | Novitsky | B21B 23/00 72/208 |

OTHER PUBLICATIONS

Thomas, Shane; Written Opinion of the International Searching Authority from corresponding International Patent Application No. PCT/US2015/044129; dated Nov. 12, 2015; pp. 1-7, United States Patent and Trademark Office as International Searching Authority; Alexandria, Virginia, USA.

Author Unknown, Edge Bead Roll Sets, Mittler Bros. [online]; Jul. 30, 2014, retrieved on Oct. 13, 2015 from https://web.archive.org/web/20140730144048/http://www.mittlerbros.com/mittler-bros/bead-rollers/rotary-machine-bead-rolls/edge-roll-sets/edge-bead-roll-sets-k.html; pp. 1-2.

Author Unknown; Gruvlok 3006/3006C Roll Groover Manual; Jul. 2009; Anvil International.

* cited by examiner

ROLLER FOR ROLL FORMING

CROSS REFERENCE TO RELATED APPLICATION

This application is based upon and claims priority to U.S. Provisional Application No. 62/043,591 filed Aug. 29, 2014 and hereby incorporated by reference.

FIELD OF THE INVENTION

This invention relates to rollers for roll forming pipe elements, and to an apparatus using rollers for roll forming.

BACKGROUND

Circumferential grooves and other features such as shoulders and beads may be formed in pipe elements by various methods, one of particular interest being roll grooving. As shown in FIG. 1, roll grooving methods involve engaging an inner roller 10 with an inner surface 12 of a pipe element 14 and an outer roller 16 with an outer surface 18 of the pipe element opposite to the inner roller and incrementally compressing the sidewall 20 of the pipe element 14 between the rollers 10 and 16 while rotating at least one of the rollers. Rotation of one roller (often the inner roller) causes relative rotation between the roller set and the pipe element, and features on the inner and outer rollers form corresponding features on the inner and outer surfaces of the pipe element. In one example roll grooving method the rollers remain in a fixed location and the pipe element rotates about its longitudinal axis relative to the rollers. In another example embodiment the pipe element remains stationary and the roller set traverses the pipe element's circumference.

During roll formation of circumferential grooves in pipe elements a problem may arise if the direction of the force applied to the pipe element by the outer roller is not substantially perpendicular to the longitudinal axis 22 of the pipe element 14 (i.e., the rotational axis of the pipe element). This may occur for example, when forming a circumferential groove 24 having an asymmetrical cross sectional shape, as shown in FIGS. 1 and 1A. Although the force 26 applied to outer roller 16 during groove formation is substantially perpendicular to the rotational axis 22 of the pipe element 14, interaction between the pipe element 14 and the angularly oriented face 28 of the raised surface feature 30 of the outer roller 16 imparts an axial force component 32 (i.e. parallel to the axis 22) to the pipe element 14. The axial force component 32 is not counteracted due to the asymmetry of the raised surface feature 30, the face 34 opposite angular face 28 being oriented substantially perpendicularly to the rotational axis 22 of the pipe element 14 and the intermediate face 35 (extending between faces 28 and 34) being substantially parallel to the rotational axis 22. The geometry of faces 34 and 35 render them unable to counteract the axial force component 32. The axial force component 32 increases the force between perpendicular face 34 of the outer roller 16 and the pipe element 14, specifically, between face 34 and the side surface 36 of groove 24. As the groove 24 is formed the increased force between face 34 and the side surface 36 of the groove 24 increases the friction between these surfaces. It is believed that this increase in friction between face 34 and the side surface 36 causes the intermediate surface 35 of outer roller 16 to slip relatively to the floor surface 37 of the groove 24. This slippage between intermediate surface 35 of the raised surface feature 30 and the floor surface 37 of groove 24 makes it difficult to use the rotation of outer roller 16 to measure and thereby accurately form a groove 24 having a desired circumference as measured at the groove floor surface 37. (Note that the circumference of the pipe element, or a groove therein, may be calculated knowing the diameter of the outer roller and the number of rotations it experiences while traversing the pipe element circumference without slipping relative to the pipe element.) There is clearly an opportunity to improve outer rollers for roll grooving that will permit accurate measuring and monitoring of the circumferential groove having an asymmetrical cross sectional shape during groove formation.

SUMMARY

The invention concerns a roller for roll forming pipe elements. In one example embodiment, the roller comprises a body having an axis of rotation and a perimeter region positioned radially distal to and surrounding the axis. The perimeter region comprises a first face oriented transversely to the axis, a second face, contiguous with the first face, and a third face, contiguous with the second face and oriented transversely to the axis. A channel is positioned in the third face and extends around the perimeter region.

In a particular embodiment, the body has a cylindrical cross section. The axis of rotation may be coaxial with the cylindrical cross section by way of example. In a specific example embodiment, the first face is angularly oriented with respect to the axis. In a further example embodiment, the third face is oriented substantially perpendicularly to the axis. By way of example, the second face may be oriented substantially parallel to the axis. By way of example, the first face may have an orientation angle from about 30° to about 70° with respect to the axis. In a specific example, the first face has an orientation angle of about 50° with respect to the axis.

In another example embodiment of a roller for roll forming pipe elements, the roller comprises a body having an axis of rotation and an outer surface surrounding the axis. In this example the outer surface comprises a raised surface portion extending around the body and projecting outwardly from the axis. By way of example the raised surface portion comprises a first face oriented transversely to the axis, a second face, contiguous with the first face, and a third face, contiguous with the second face and oriented transversely to the axis. A channel is positioned in the third face and extends around the body. In an example the body has a cylindrical cross section and the axis may be coaxial with the cylindrical cross section.

The invention further encompasses an apparatus for roll forming a pipe element. In one example embodiment the apparatus comprises an outer roller engageable with an outer surface of the pipe element. By way of example the outer roller comprises a body rotatable about a first axis of rotation, the body having a perimeter region positioned radially distal to and surrounding the first axis. In an example embodiment the perimeter region comprises a first face oriented transversely to the first axis, a second face, contiguous with the first face, and a third face, contiguous with the second face and oriented transversely to the first axis. A channel is positioned in the third face and extends around the perimeter region. In this example the apparatus further comprises an inner roller engageable with an inner surface of the pipe element, the inner roller being rotatable about a second axis of rotation oriented substantially parallel to the first axis. The example apparatus may further comprise an actuator for moving the inner and outer rollers toward and away from one another, and a motor for rotating one of the inner and outer rollers. Again by way of example, the apparatus may have an inner roller comprising a circumferential trough receiving the perimeter region when the inner and outer rollers are moved toward one another. The trough is defined by a first shoulder and a second shoulder positioned in spaced relation from the first shoulder. The first shoulder is positioned adjacent to but not underlying the first face of the perimeter region.

In another example embodiment of an apparatus for roll forming a pipe element, the apparatus comprises an outer roller engageable with an outer surface of the pipe element and rotatable about a first axis of rotation. In this example embodiment, the outer roller comprises a body having an outer surface surrounding the first axis. The outer surface in this example may comprise a raised surface portion extending around the body and projecting outwardly from the first axis. The raised surface portion may comprise a first face oriented transversely to the first axis, a second face, contiguous with the first face, and a third face, contiguous with the second face and oriented transversely to the first axis. A channel is positioned in the third face and extends around the body. By way of example the apparatus further comprises an inner roller engageable with an inner surface of the pipe element. The inner roller is rotatable about a second axis of rotation oriented substantially parallel to the first axis. An actuator for moving the inner and outer rollers toward and away from one another and a motor for rotating one of the inner and outer rollers is also part of this example embodiment. Further by way of an example apparatus, the inner roller comprises a circumferential trough receiving the raised surface portion when the inner and outer rollers are moved toward one another. The trough is defined by a first shoulder and a second shoulder positioned in spaced relation from the first shoulder. The first shoulder is positioned adjacent to but not underlying the first face of the raised surface portion.

DETAILED DESCRIPTION

Figure 2:
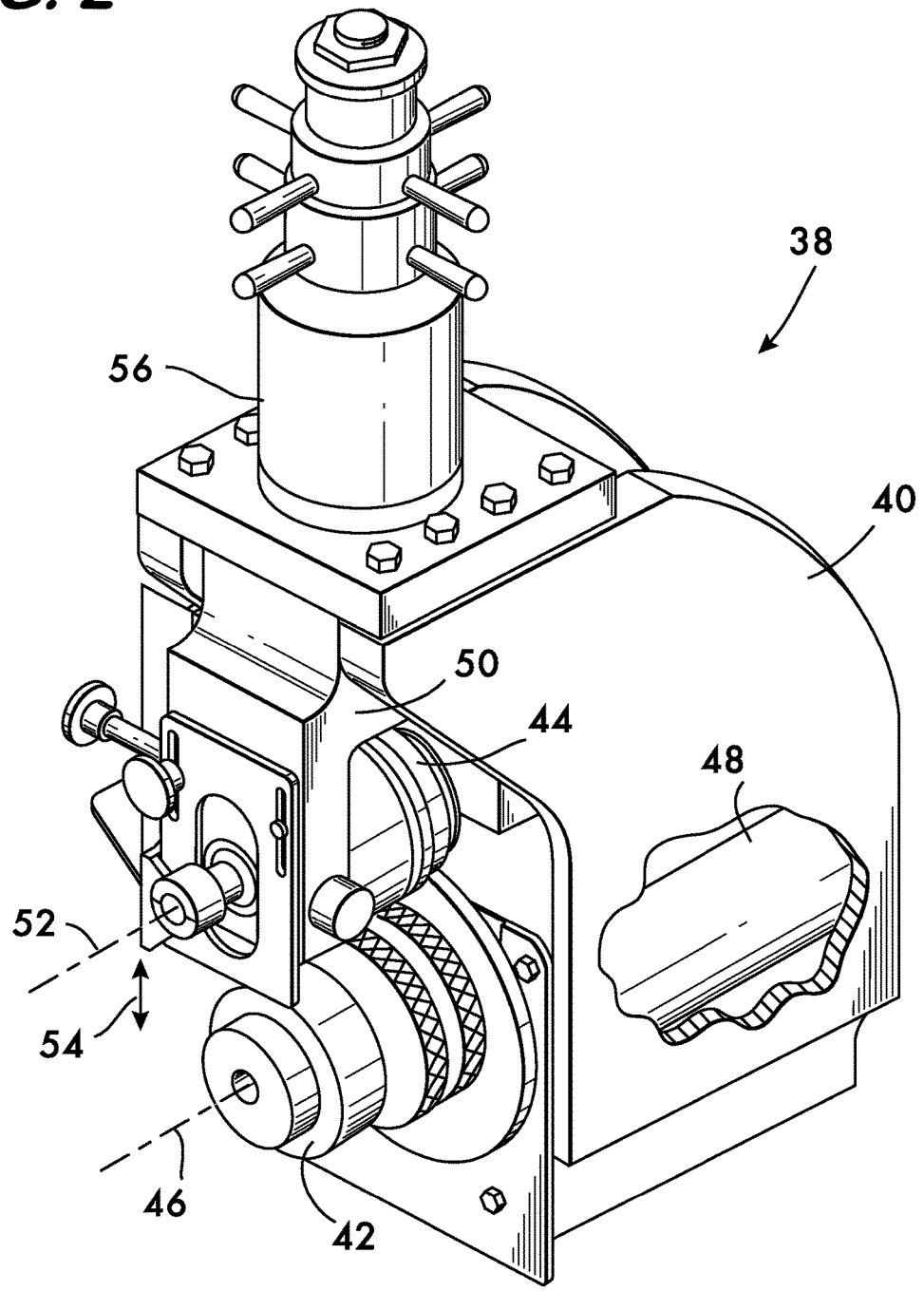
FIG. 2 is an isometric view of an apparatus for roll forming pipe elements.

FIG. 2 shows an apparatus 38 for roll forming pipe elements. Apparatus 38 comprises a housing 40 on which an inner roller 42 and an outer roller 44 according to the invention are rotatably mounted. Inner roller 42 rotates about rotation axis 46, in this example driven by electrical motor 48. Outer roller 44 is an idler and is mounted on a yoke 50 for rotation about an axis 52, preferably oriented substantially parallel (in both the horizontal and vertical planes) to axis 46 of the inner roller 42. Yoke 50 is movable toward and away from inner roller 42 as illustrated by arrow 54, in this example by a hydraulic actuator 56.

Figure 3:
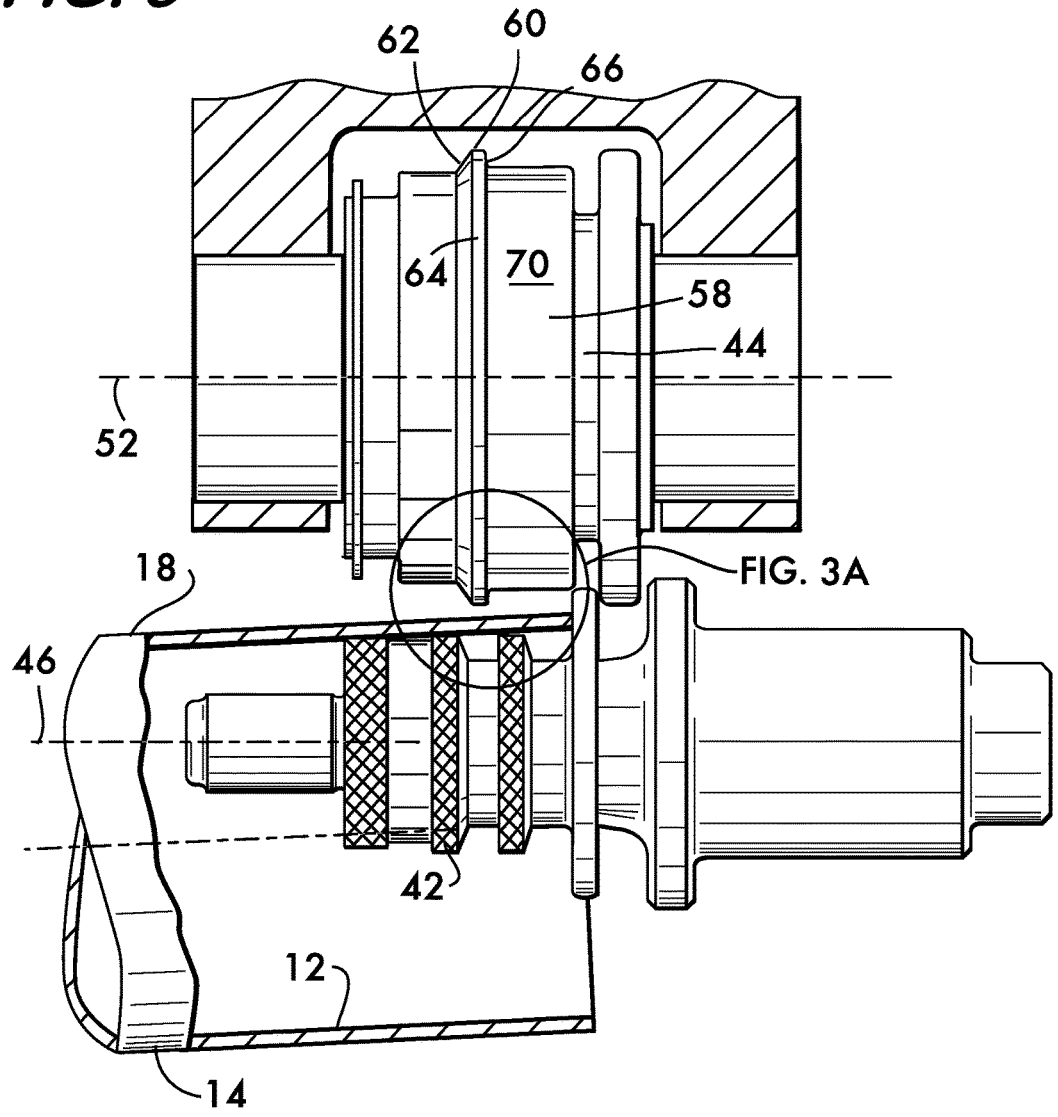
FIGS. 3-5 are partial longitudinal sectional views of a portion of the apparatus shown in FIG. 2 illustrating use of an example outer roller according to the invention.
Figure 3A:
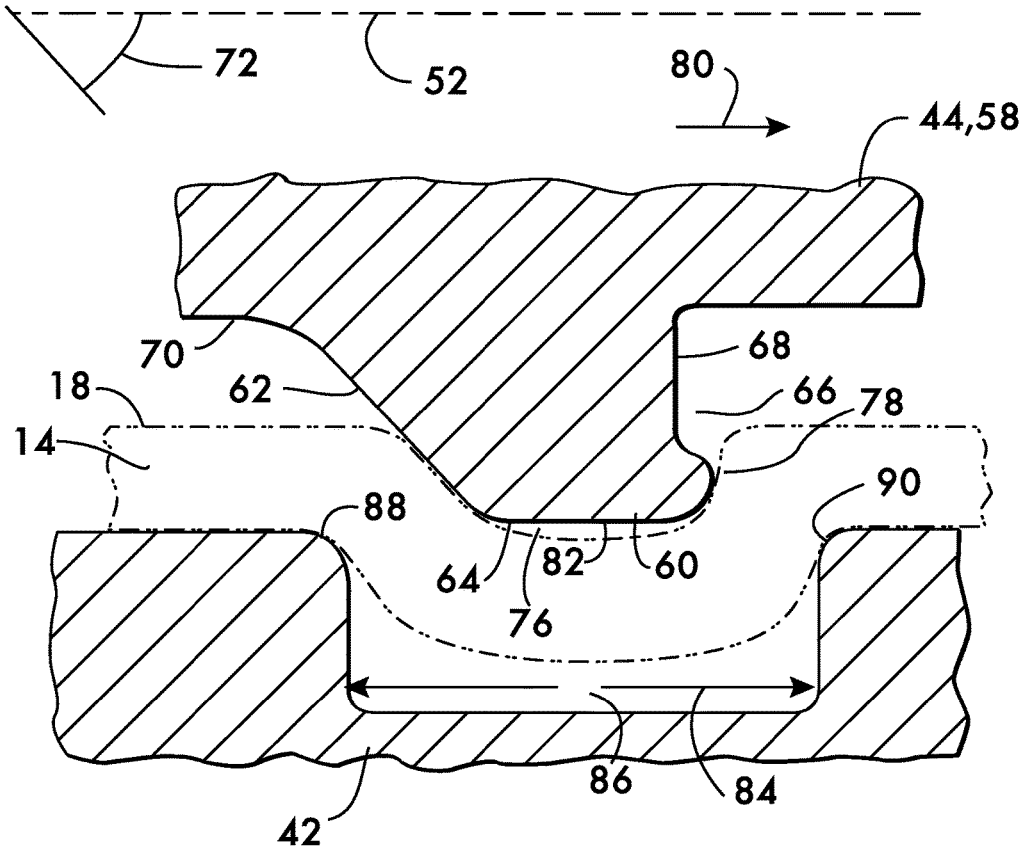
FIG. 3A is a longitudinal sectional view taken at circle 3A of FIG. 3 and shown on an enlarged scale.

As shown in FIGS. 3 and 3A, an example outer roller 44 according to the invention comprises a body 58 with axis of rotation 52. Body 58 has a perimeter region 60 positioned radially distal to axis 52. Perimeter region 60 surrounds axis 52 and comprises a first face 62 oriented transversely to axis 52, a second face 64 contiguous with the first face 62, and a third face 66, contiguous with the second face 64 and oriented transversely to axis 52. As shown in detail in FIG. 3A, a channel 68 is positioned in the third face 66. Channel 68 extends around the perimeter region 60. Outer roller 44 may also comprise an outer surface 70 that surrounds axis of rotation 52. In this example embodiment the perimeter region 60 may be described as a raised surface portion extending around the body 58 and projecting outwardly from the outer surface 70 and axis 52.

In the particular example embodiment of outer roller 44 shown in FIGS. 3 and 3A the body 58 has a cylindrical cross section, with the axis of rotation 52 being coaxial therewith. Outer roller 44 is designed to form an asymmetrical circumferential groove in a pipe element, with first face 62 angularly oriented with respect to axis 52, second face 64 being substantially parallel to axis 52, and the third face 66 being oriented substantially perpendicular to axis 52. In a practical example of an outer roller 44, the first face 62 may have an orientation angle 72 relative to axis 52 from about 30° to about 70°, with an orientation angle 72 of about 50° being thought advantageous.

Figure 4:
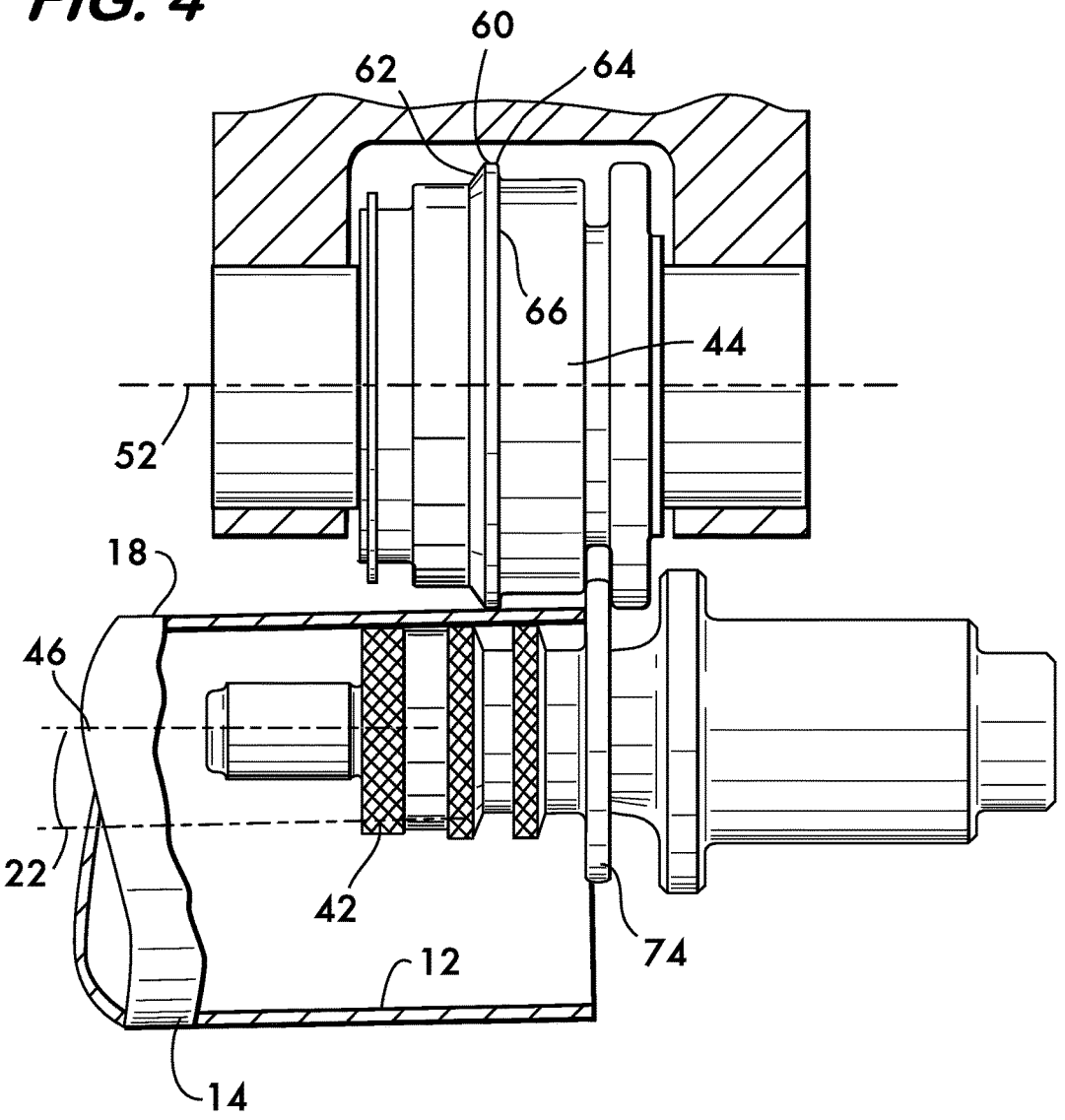
Figure 5:
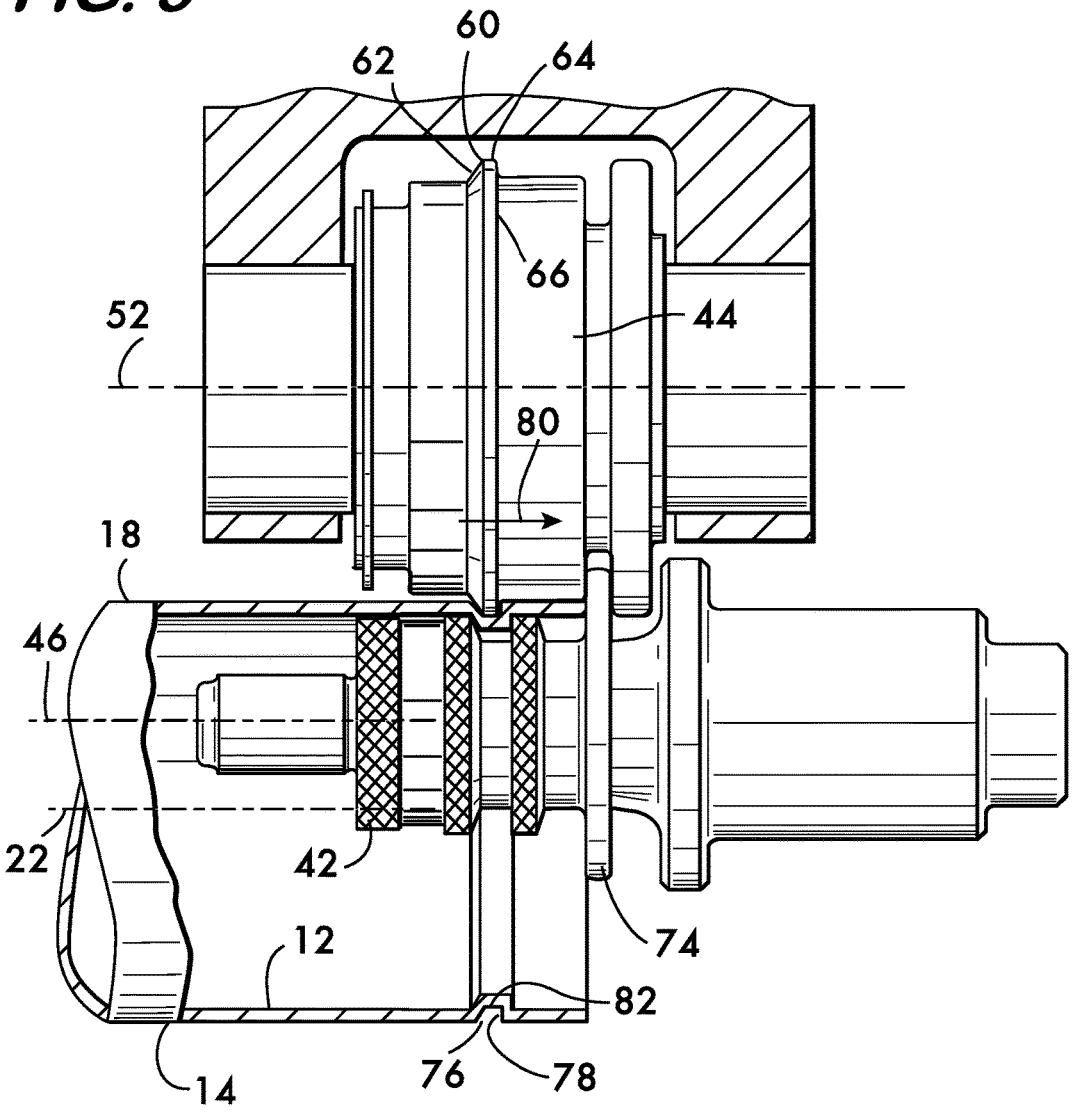

In operation, as shown in FIGS. 4 and 5, the inner surface 12 of pipe element 14 is engaged with the inner roller 42, the end of the pipe element preferably engaging the inner roller's flange 74. Hydraulic actuator 56 (see also FIG. 2) moves the outer roller 44 into engagement with the outer surface 18 of pipe element 14. Motor 48 rotates the inner roller 42 about axis 46 while the actuator 56 forces the outer roller 44 against the outer surface 18 of the pipe element 14, thereby roll forming a circumferential groove 76 in the pipe element, the outer roller 44 rotating about its axis 52 as an idler and the pipe element 14 rotating about its longitudinal axis 22.

Figure 1:
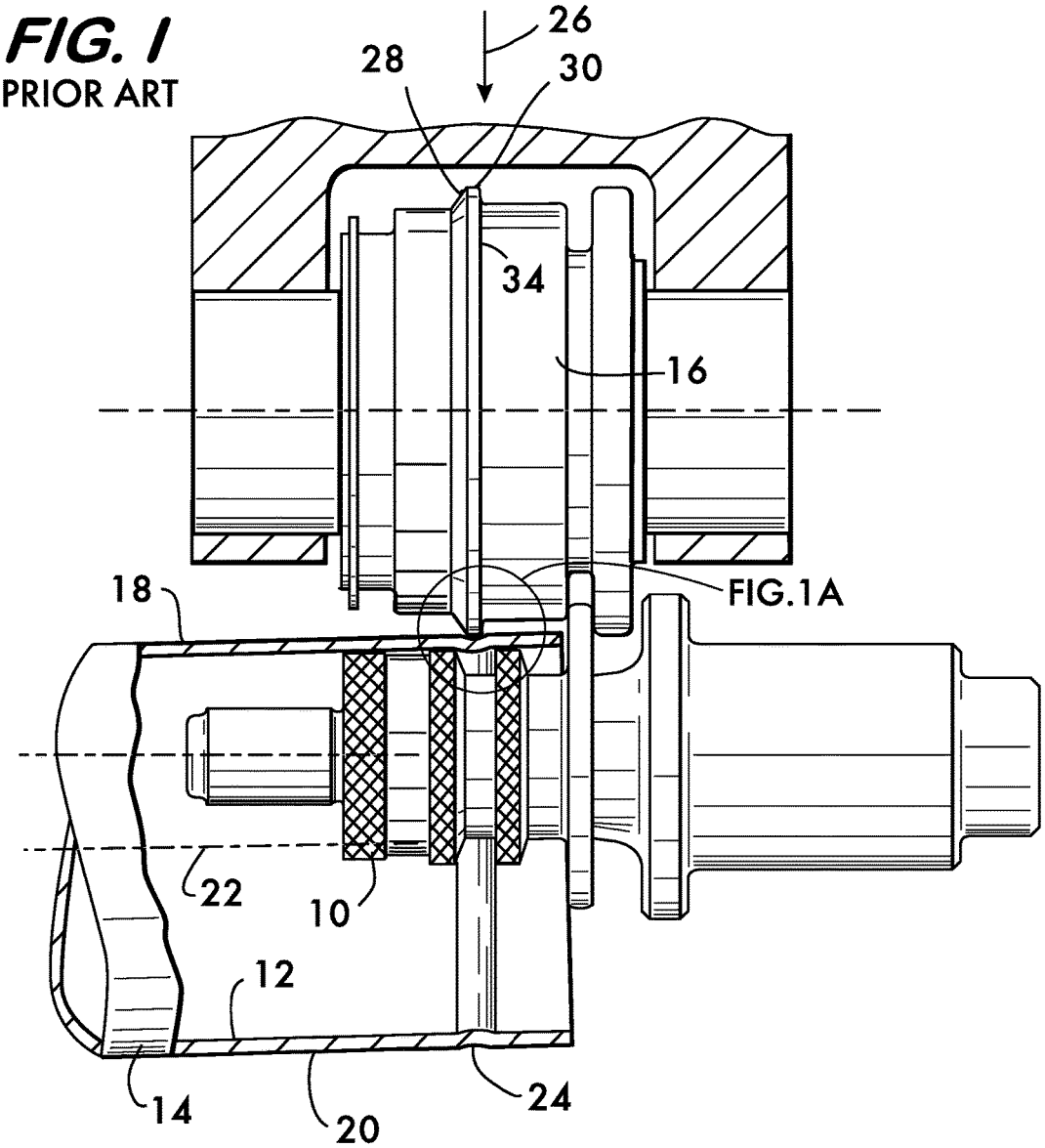
FIG. 1 PRIOR ART
FIG. 1 is a partial longitudinal sectional view of a roller set according to the prior art for roll forming circumferential grooves in pipe elements.
Figure 1A:
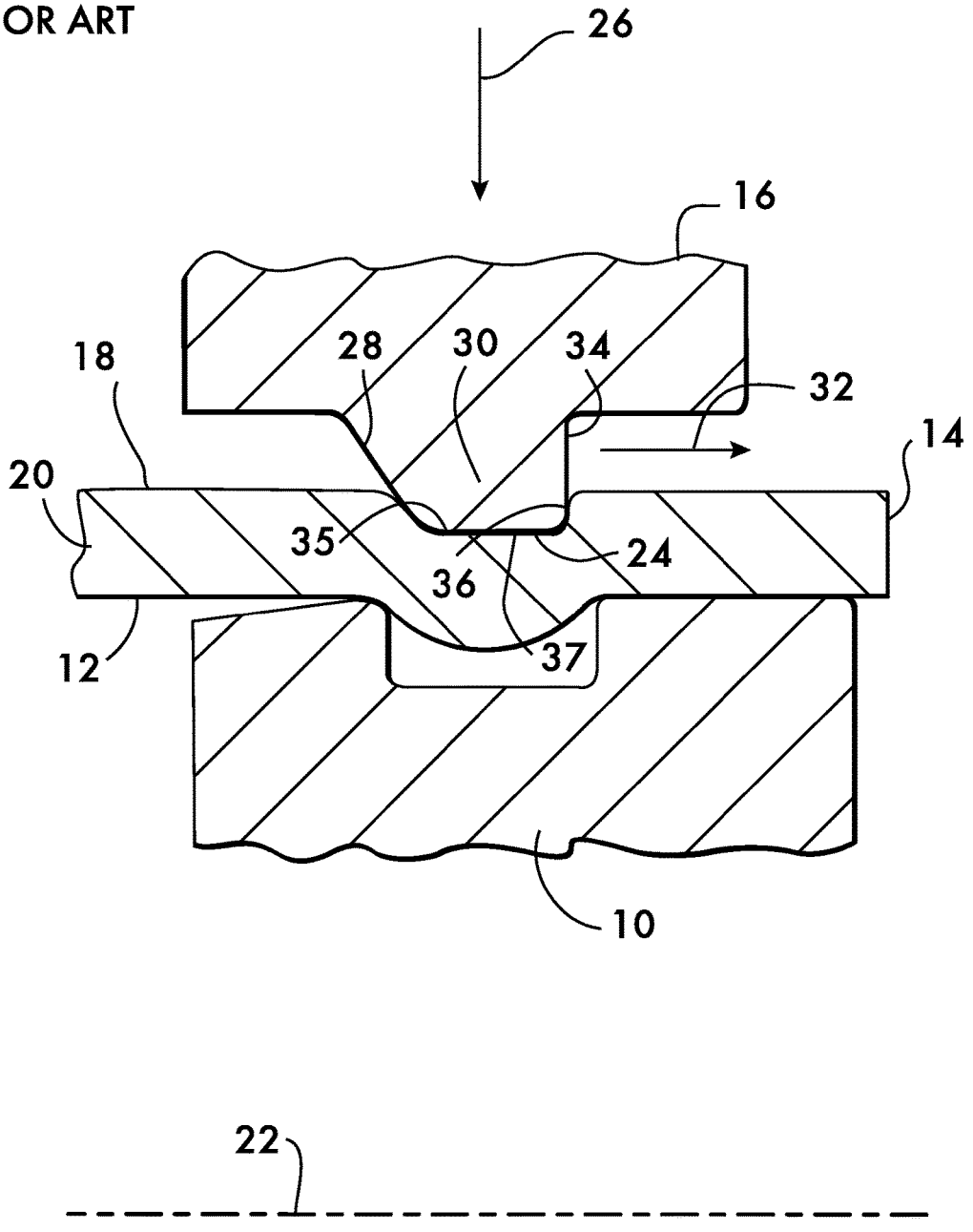
FIG. 1A PRIOR ART
FIG. 1A is a longitudinal sectional view taken at circle 1A of FIG. 1 and shown on an enlarged scale.

Due to the asymmetrical shape of the perimeter region 60 that forms the circumferential groove 76 in the pipe element 14, there will be an axially oriented component load between the third face 66 of outer roller 44 and the side surface 78 of groove 76 as illustrated by arrow 80 in FIGS. 3A and 5. In prior art outer rollers 16 lacking a channel 68 in the face 34 opposite to the angled face 28 (see FIG. 1A) the axial load 32 increases the friction between the face 34 and the side surface 36 of the circumferential groove 24 in the pipe element. However, when channel 68 is present, as in the example outer roller embodiment 44 according to the invention as shown in FIGS. 3A, 4 and 5, the channel 68 provides a void space that reduces the contact area between third face 66 and groove side surface 78. It is thought that third face 66 cannot gain purchase against the side surface 78 due to the reduced contact area afforded by the void space provided by channel 68, and, consistent with observation, there is significantly less slippage between second surface 64 of roller 44 and the floor surface 82 of groove 76.

As illustrated in FIG. 3A, it is found that the axially oriented component load 80 itself can be reduced by controlling the width 84 of the trough 86 in the inner roller 42 which receives the deformed portion of the pipe element 14 comprising the groove 76. The trough 86 is defined by first and second shoulders 88 and 90 positioned in spaced relation. To reduce the axially oriented component load 80, width 84 is controlled by the position of shoulder 88 relative to the first face 62 of perimeter region 60. As shown in FIG.

3A, the reduction of the axially oriented component load 80 is advantageously effected by positioning the shoulder 88 of the trough 86 adjacent to but not underlying the first face 62 of the perimeter region 60. This relation between trough shoulder 88 and first face 62 is believed to reduce the pinching of the pipe element 14 between the rollers 42 and 44, thereby reducing the axially oriented component load 80. This force reduction reduces slipping between the second face 64 and groove floor 82, consequently friction between the rollers and the pipe element is reduced and the groove is formed with less vibration, less applied force and less heating.

What is claimed is:

1. An apparatus for roll forming a pipe element, said apparatus comprising:

an outer roller engageable with an outer surface of said pipe element, said outer roller comprising:

a body rotatable about a first axis of rotation, said body having a perimeter region positioned radially distal to and surrounding said first axis, said perimeter region comprising:

a first face oriented transversely to said first axis;

a second face, contiguous with said first face;

a third face, contiguous with said second face and oriented transversely to said first axis;

a channel positioned in said third face and extending around said perimeter region;

said apparatus further comprising:

an inner roller engageable with an inner surface of said pipe element, said inner roller being rotatable about a second axis of rotation oriented substantially parallel to said first axis;

an actuator for moving said inner and outer rollers toward and away from one another; and a motor for rotating one of said inner and outer rollers.

2. The apparatus according to claim 1, wherein said body has a cylindrical cross section.

3. The apparatus according to claim 2, wherein said first axis is coaxial with said cylindrical cross section.

4. The apparatus according to claim 1, wherein said first face is angularly oriented with respect to said first axis.

5. The apparatus according to claim 4, wherein said third face is oriented substantially perpendicularly to said first axis.

6. The apparatus according to claim 5, wherein said second face is oriented substantially parallel to said first axis.

7. The apparatus according to claim 4, wherein said first face has an orientation angle from 30° to 70° with respect to said first axis.

8. The apparatus according to claim 4, wherein said first face has an orientation angle of 50° with respect to said first axis.

9. The apparatus according to claim 1, wherein said third face is oriented substantially perpendicularly to said first axis.

10. The apparatus according to claim 1, wherein said second face is oriented substantially parallel to said first axis.

11. The apparatus according to claim 1, wherein said inner roller comprises a circumferential trough receiving said perimeter region when said inner and outer rollers are moved toward one another, said trough defined by a first shoulder and a second shoulder positioned in spaced relation from said first shoulder, said first shoulder being positioned adjacent to but not underlying said first face of said perimeter region.

12. An apparatus for roll forming a pipe element, said apparatus comprising:

an outer roller engageable with an outer surface of said pipe element and rotatable about a first axis of rotation, said outer roller comprising:

a body having an outer surface surrounding said first axis, said outer surface comprising a raised surface portion extending around said body and projecting outwardly from said first axis, said raised surface portion comprising:

a first face oriented transversely to said first axis;

a second face, contiguous with said first face;

a third face, contiguous with said second face and oriented transversely to said first axis;

a channel positioned in said third face and extending around said body;

said apparatus further comprising:

an inner roller engageable with an inner surface of said pipe element, said inner roller being rotatable about a second axis of rotation oriented substantially parallel to said first axis;

an actuator for moving said inner and outer rollers toward and away from one another; and a motor for rotating one of said inner and outer rollers.

13. The apparatus according to claim 12, wherein said body has a cylindrical cross section.

14. The apparatus according to claim 13, wherein said first axis is coaxial with said cylindrical cross section.

15. The apparatus according to claim 12, wherein said first face is angularly oriented with respect to said first axis.

16. The apparatus according to claim 15, wherein said third face is oriented substantially perpendicularly to said first axis.

17. The apparatus according to claim 16, wherein said second face is oriented substantially parallel to said first axis.

18. The apparatus according to claim 15, wherein said first face has an orientation angle from 30° to 70° with respect to said first axis.

19. The apparatus according to claim 15, wherein said first face has an orientation angle of 50° with respect to said first axis.

20. The apparatus according to claim 12, wherein said third face is oriented substantially perpendicularly to said first axis.

21. The apparatus according to claim 12, wherein said second face is oriented substantially parallel to said first axis.

22. The apparatus according to claim 12, wherein said inner roller comprises a circumferential trough receiving said raised surface portion when said inner and outer rollers are moved toward one another, said trough defined by a first shoulder and a second shoulder positioned in spaced relation from said first shoulder, said first shoulder being positioned adjacent to but not underlying said first face of said raised surface portion.

* * * * *